US005782064A

United States Patent [19]

Beeman

[11] Patent Number: 5,782,064

[45] Date of Patent: Jul. 21, 1998

[54] BOX FOLDING APPARATUS

[75] Inventor: John A. Beeman, Dayton, Ohio

[73] Assignee: The Mead Corporation, Dayton, Ohio

[21] Appl. No.: 874,565

[22] Filed: Jun. 13, 1997

[51] Int. Cl.[6] ..... B65B 5/04; B65B 7/20; B65B 49/02; B65B 49/08

[52] U.S. Cl. ..... 53/467; 53/491; 53/377.2; 53/377.3; 53/377.6; 53/387.2

[58] Field of Search ..... 53/491, 377.2, 53/377.6, 377.3, 564, 284, 387.2, 458; 493/117

[56] References Cited

U.S. PATENT DOCUMENTS

| | | | |
|---|---|---|---|
| 2,734,323 | 2/1956 | Laub, III | 53/491 X |
| 3,225,666 | 12/1965 | Reimers . | |
| 3,509,681 | 5/1970 | Sass . | |
| 3,959,950 | 6/1976 | Fukuda | 53/377.2 X |
| 4,422,282 | 12/1983 | Marchetti . | |
| 4,515,581 | 5/1985 | Molitor et al. | 53/377.2 X |
| 4,570,421 | 2/1986 | Focke et al. | 53/377.2 X |
| 4,589,862 | 5/1986 | Murrah . | |
| 4,642,966 | 2/1987 | Marchetti . | |
| 4,698,950 | 10/1987 | Marchetti . | |
| 4,955,177 | 9/1990 | Lerner et al. . | |
| 5,022,214 | 6/1991 | Kim . | |
| 5,115,625 | 5/1992 | Barbulesco et al. | 53/491 X |
| 5,324,250 | 6/1994 | Janson . | |
| 5,417,032 | 5/1995 | Calvert et al. . | |
| 5,454,776 | 10/1995 | Ulrich et al. | 53/377.2 X |
| 5,573,490 | 11/1996 | Steinbrenner et al. . | |

*Primary Examiner*—Horace M. Culver
*Attorney, Agent, or Firm*—Thompson Hine & Flory LLP

[57] ABSTRACT

An apparatus for folding the minor flaps of an unfolded sleeve around an item to be packaged, thereby minimizing the amount of handling required. The apparatus folds a sleeve around the item to be packaged. The sleeve has four walls, each wall having a lower edge defining a lower perimeter, and further having a first and second unfolded panel extending downwardly from the walls. The apparatus comprises a first fold bar located upstream of the box, and a second fold bar located downstream of the box. Each fold bar has a folding portion located at substantially the same height as the perimeter, such that when the fold bar is moved into contact with an unfolded panel, the fold bar contacts and folds an unfolded flap into the plane of the perimeter. In a preferred embodiment, the first fold bar is moved into contact with a first panel, and the sleeve is moved downstream to cause the second fold bar to contact the second panel.

19 Claims, 8 Drawing Sheets

BOX FOLDING APPARATUS

BACKGROUND OF THE INVENTION

The present invention relates to apparatuses and methods for folding cartons about an item to be packaged and, more particularly, to apparatuses and methods for supporting an item to be packaged while folding the minor flaps of an unfolded carton around the item to form the bottom of a box.

In the packaging industry, many automated and semi-automatic machines are used to aid in the packaging process, and it is generally desirable to automate as many steps as possible. Increased ease of operation, efficiency, and greater speed all result from expanded automation. Accordingly, there are many box folding machines which operate so as to automatically package products and prepare them for shipping. However, nearly all existing assemblies require the packaging carton to be at least partially formed before the machine can complete the rest of the folding and sealing sequence. The trailing minor flap, in particular, must usually be manually folded into position before most machines can continue their operations in folding the remaining panels. Furthermore, most existing machines require the product to be manually lifted and placed into the partially formed box.

Accordingly, there exists a need for an apparatus that can automatically fold the trailing minor flap of an unfolded carton box, and that can fold a carton around the item to be packaged while requiring relatively little handling of the product. Furthermore, there exists a need for an apparatus that can perform the aforementioned operation in a quick and efficient manner, while producing consistent and repeatable results.

SUMMARY OF THE INVENTION

The present invention is a box folding apparatus for folding the minor flaps of an unfolded carton sleeve, and which can fold a carton around a product with little or no handling of the product. The apparatus of the present invention eliminates the need for manual folding, and for worker lifting and placement of the product in a partially folded carton. The only manual operation required is the placing of the unfolded carton, as a sleeve, around the item to be packaged. Once this is accomplished, the minor panels are folded, and the remaining panels are folded as the carton travels downstream. The apparatus operates quickly and efficiently, and performs consistent and repeatable operations upon the unfolded carton.

Furthermore, the apparatus of the present invention is easily adaptable to accommodate cartons of differing sizes. It has adjustable tabs to account for cartons of varying heights, an adjustable fold bar to account for varying lengths, and movable conveyor bars to account for boxes of varying depths. Furthermore, in the preferred embodiment of the invention adjustments may be accomplished quickly and easily by an on-site worker without requiring any tools. A further advantage is that a carton in use may be used to guide the adjustments, which allows for quick and accurate on-the-fly adjustments.

Accordingly, the present invention comprises an apparatus for folding a box around an item to thereby package the item in the box. The box is formed from a sleeve having a front panel, a back panel, and two side panels. Each of the panels has a lower edge defining a lower perimeter. The sleeve further has a first and second unfolded bottom flap extending downwardly from the front and back panels, and two major unfolded flaps extending downwardly from the side panels. The apparatus comprises a support for the item to be packaged, a path defined by the apparatus along which the item is moved as it is packaged in the box, a first fold bar, a conveyor for moving the sleeve in a downstream direction along the path, and a second fold bar. The first fold bar is located upstream of the support and in line with the path, and has a first folding portion at substantially the same height as the support. The first fold bar is movable in a downstream direction along the path to contact and fold the first bottom flap into the plane of the perimeter. The second fold bar is located downstream of the support, and has a second folding portion at substantially the same height as the support, such that the second folding portion contacts and folds the second bottom flap into the plane of the perimeter as the sleeve containing the item is conveyed downstream along the path.

Other objects and advantages of the present invention will become apparent from the following description, the accompanying drawings and the appended claims.

DETAILED DESCRIPTION OF THE DRAWINGS

Figure 6:
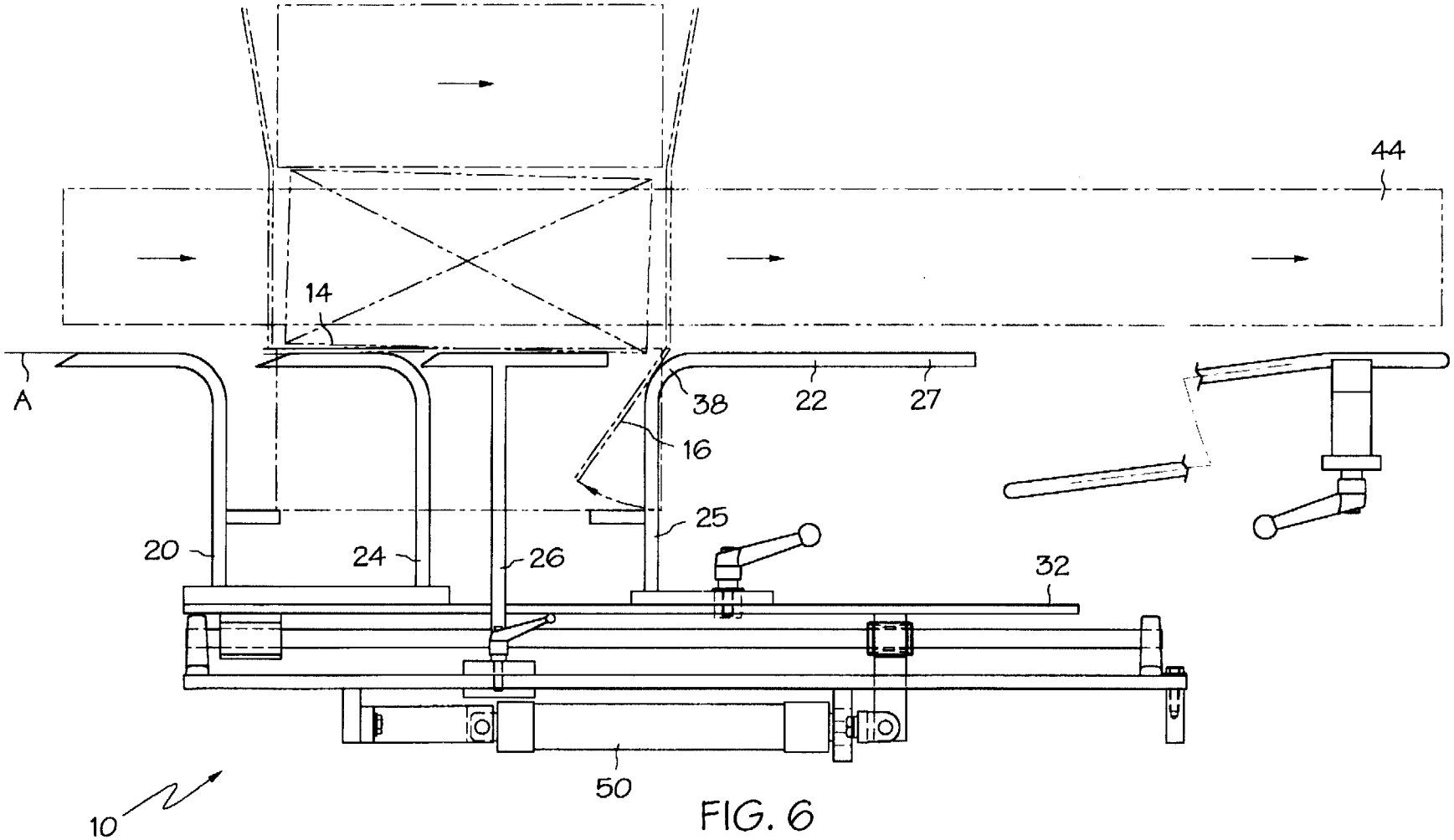
Figure 7:
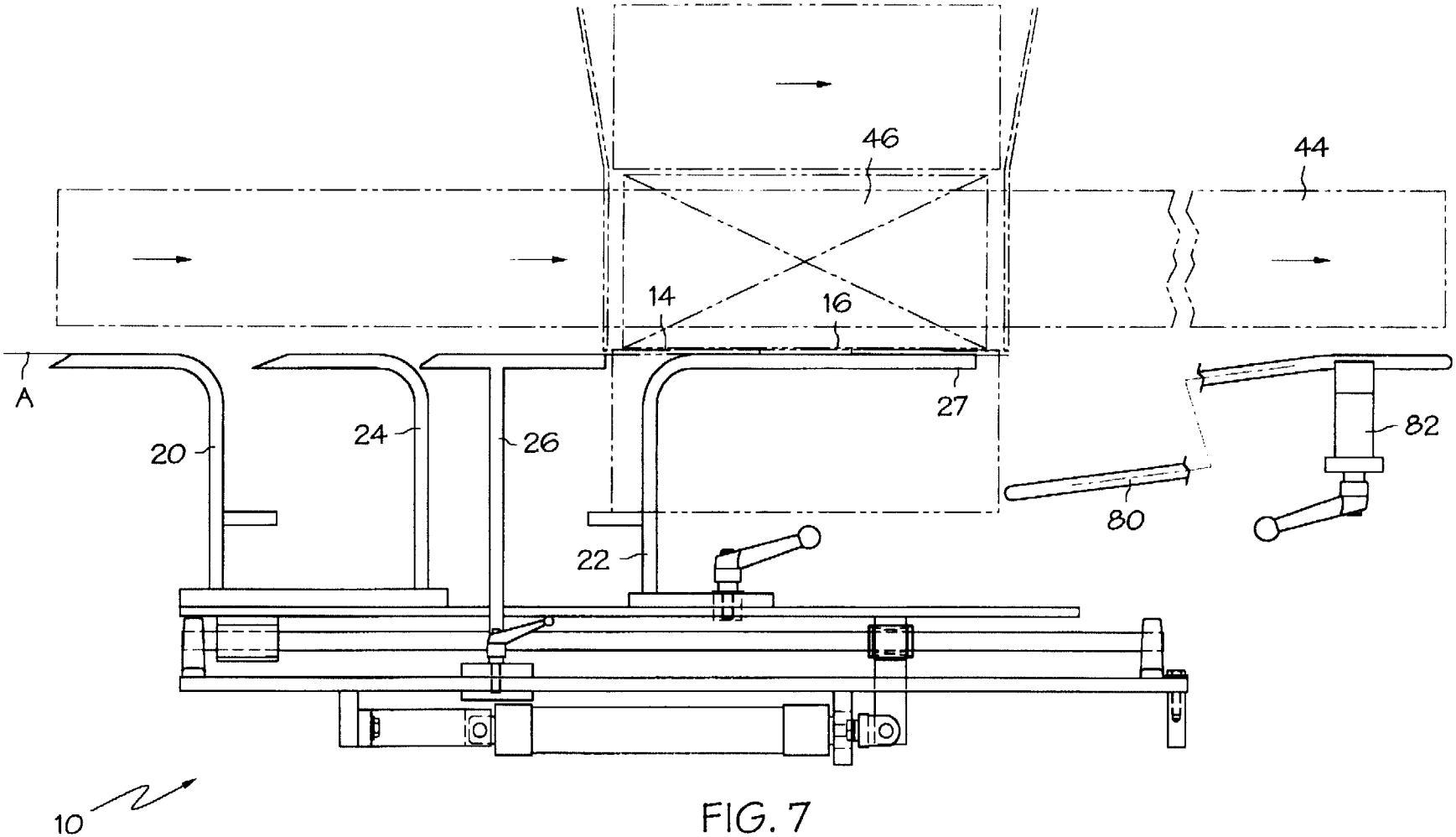
Figure 8:
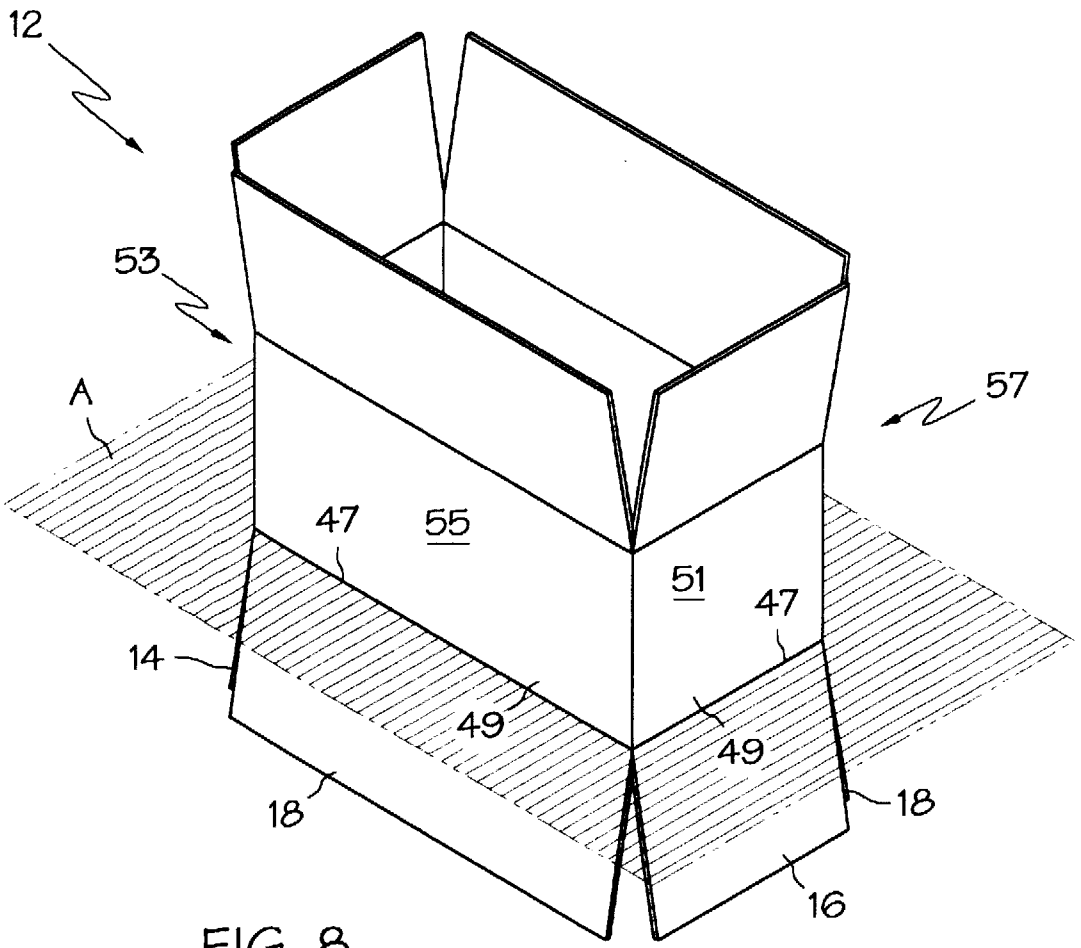
FIG. 8 is a perspective view of a sleeve for use with the box folding apparatus of FIG. 1.

As shown in FIGS. 1–7 the box folding apparatus of the present invention, generally designated 10, comprises a first fold bar 20 and a second fold bar 22. The fold bars 20, 22 are used to fold the bottom panels of an unfolded sleeve, generally designated 12. Once the bottom panels are folded, the top panels may be folded manually or by another apparatus to thereby form a box. As best shown in FIG. 8, the sleeve 12 has a front panel 51, a back panel 53, and two side panels 55, 57. The trailing minor flap 14 extends downwardly from back panel 53, leading minor flap 16 extends downwardly from front panel 51, and major flaps 18 extend downwardly from the side panels 55, 57. Each of the panels 51, 53, 55, 57 has a lower edge 49 that together form lower perimeter 47. Lower perimeter 47 of sleeve 12 is located in plane A.

Figure 1:
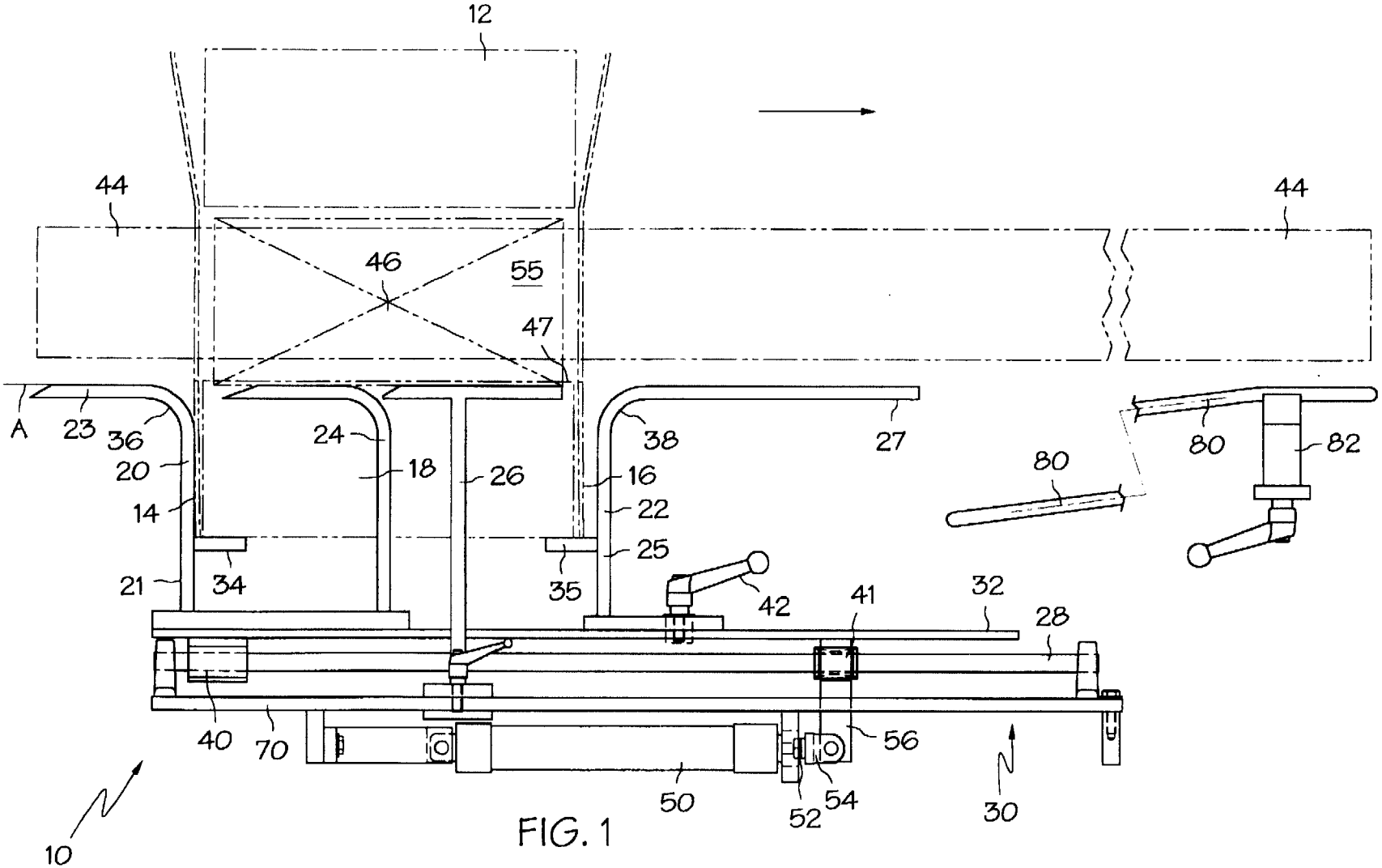
FIG. 1 is a side view elevation of the box folding apparatus of the present invention and an associated item to be packaged and unfolded sleeve.

As best shown in FIG. 1, first fold bar 20 is shaped in profile as an inverted "L", and includes a generally vertical portion 21 and a generally horizontal portion 23. First folding portion 36 comprises the curved transition between the generally vertical portion 21 and the horizontal portion 23. The second fold bar 22 similarly has a generally vertical section 25 and a generally horizontal section 27. Second folding portion 38 comprises the curved transition between the generally vertical portion 25 and the horizontal portion 27. The first folding portion 36 and second folding portion 38 are located at substantially the same elevation as plane A.

Second fold bar 22 is located downstream of the first folding bar 20. The downstream direction is the direction of the sleeve 12 as it travels through the apparatus 10, and is indicated by the arrow in FIG. 1. The arrow of FIG. 1 also represents the path of the sleeve 12 as it travels through the apparatus 10. First fold bar 20 and second fold bar 22 are mounted to shuttle 32. Shuttle 32 is capable of reciprocation along slide rod 28, and is coupled to the slide rod 28 by bearings 40, 41. Slide rod 28 is coupled to the base 30. Piston 50 having piston arm 52 is mounted to the bottom of the base 30. Bracket 54 is connected on one end to the end of piston arm 52 and on its other end to the extension arm 56. Extension arm 56 extends upwards to connect the bracket 54 to the reciprocating shuttle 32. Second fold bar 22 is adjustably mounted to shuttle 32, and is movable in the upstream or downstream direction. To allow adjustment of the second fold bar 22, handle 42 is rotated to unlock the fold bar. Once the fold bar 22 is in the desired location, it is locked in position by re-tightening the handle 42.

First fold bar 20 has a first tab 34 located near the bottom of the bar 20. Similarly, second fold bar 22 has a second tab 35 located near the bottom of the second fold bar 22. The tabs 34, 35 act as stops to retain the sleeve 12 at the desired elevation during folding.

Figure 2:
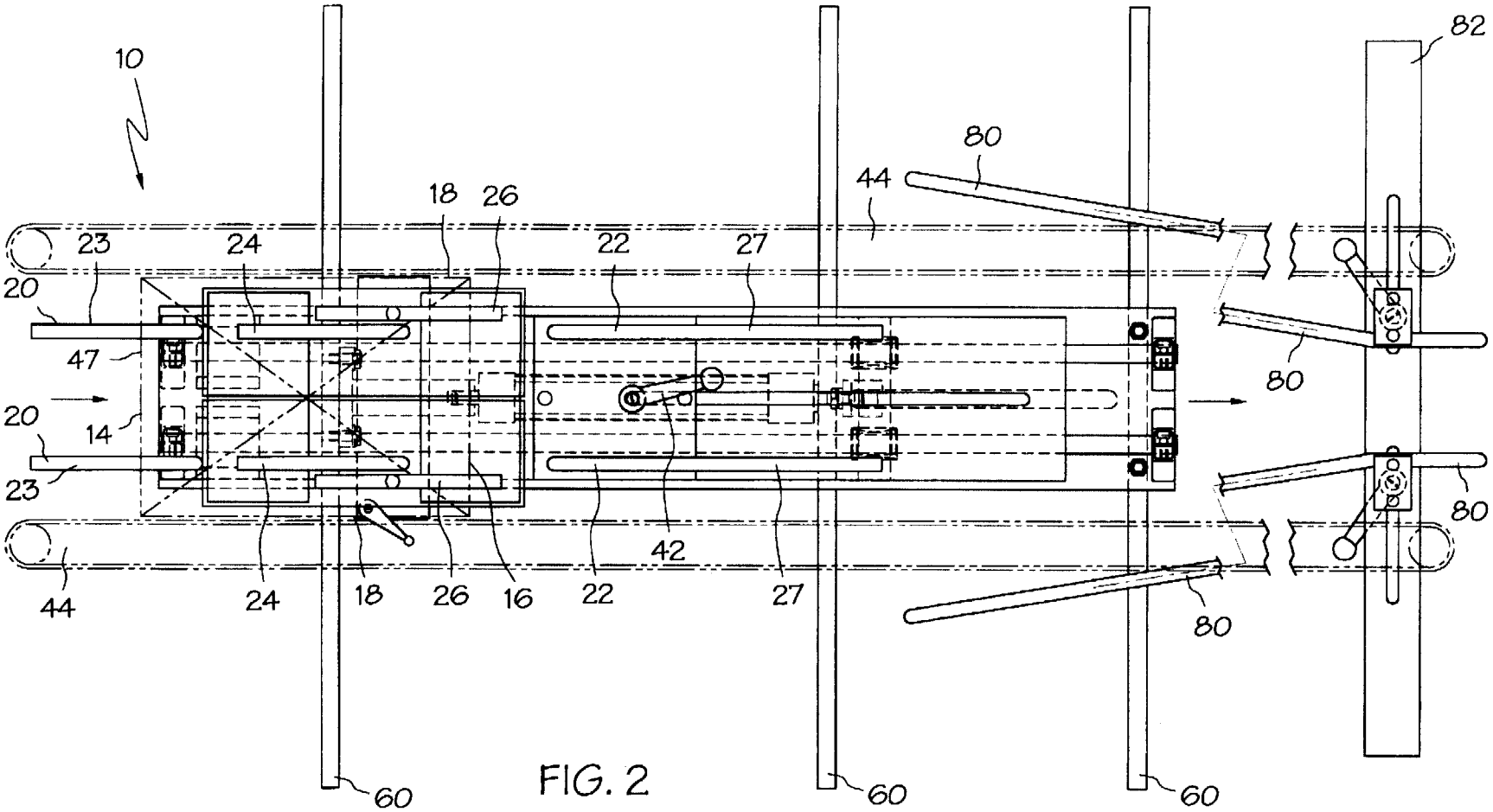
FIG. 2 is a top plan view of the box folding apparatus, item, and unfolded sleeve of FIG. 1.

"L" support bar 24 is generally shaped as an inverted "L", and supports the item to be packaged 46. "L" support bar 24 is also mounted on the reciprocating shuttle 32. "T" support bar 26 is generally shaped in profile as a "T", and further aids in supporting the item 46. "T" support bar 26 is directly mounted to the base 30 on bottom rod 70, and does not reciprocate. "T" support bar 26 is slidingly adjustable along bottom rod 70. The top of the "L" support bar and the "T" support bar are generally at the same elevation as plane A. A pair of generally vertically oriented side conveyor belts 44 extend in the upstream and downstream direction., and are capable of moving the sleeve 12 in the downstream direction. The side belts 44 are adjustable in a direction perpendicular to the upstream or downstream direction to thereby account for sleeves of varying depths. As shown in FIG. 2, each side belt 44 is movable along side belt tracks 60 to thereby vary the distance between the side belts 44. The side belts 44 also aid in retaining the sleeve 12 by clamping the side panels 55, 57 to retain the sleeve 12 at the desired elevation during folding. Although the side belts 44 discussed herein are conveyor belts, other means, such as roller, arms, or other gripping mechanisms may be used to retain and move the sleeve 12 without departing from the scope of the present invention.

Figure 3:
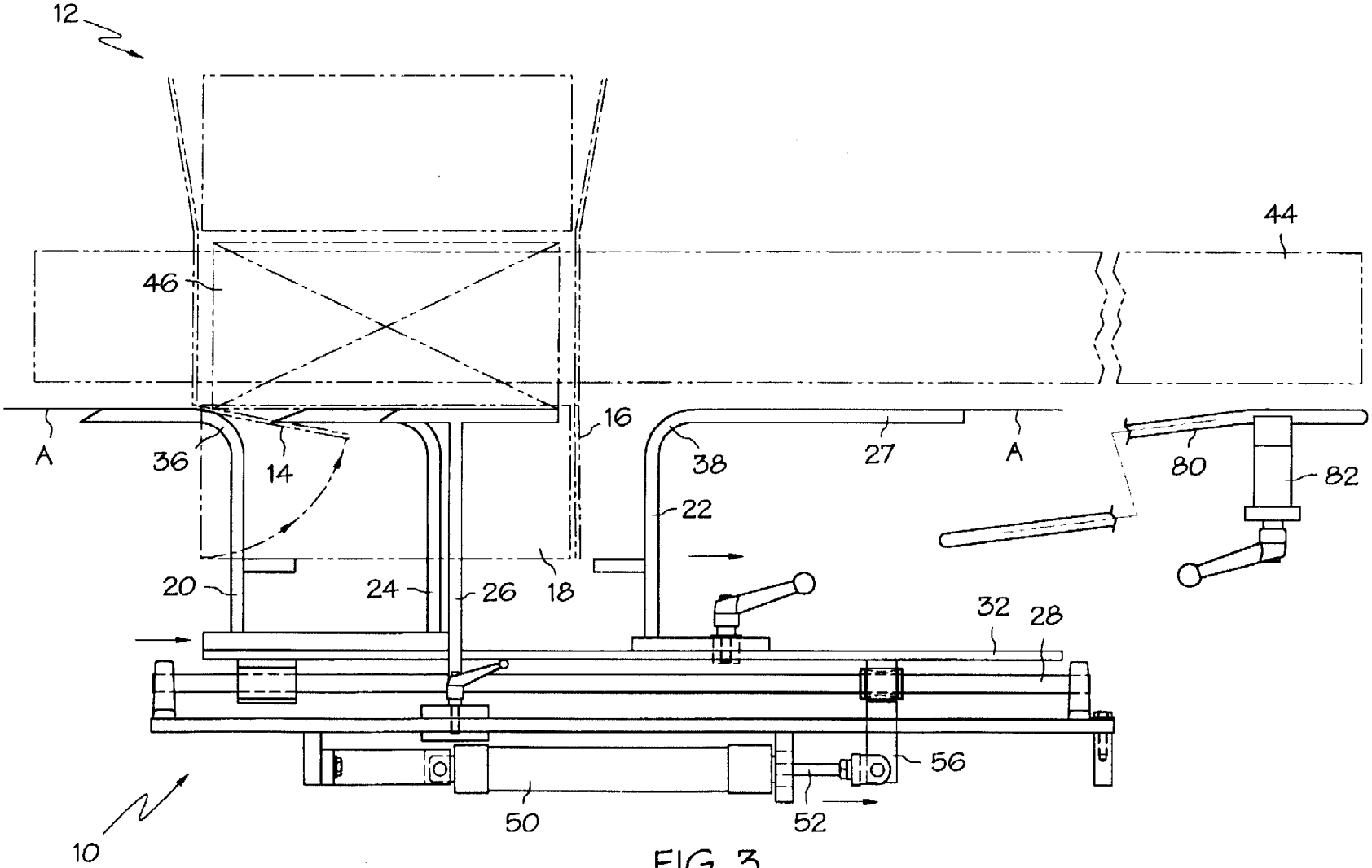
FIGS. 3–7 show the sequence of operation in side view for folding the minor flaps of an unfolded sleeve as performed by the box folding apparatus of FIG. 1.
Figure 4:
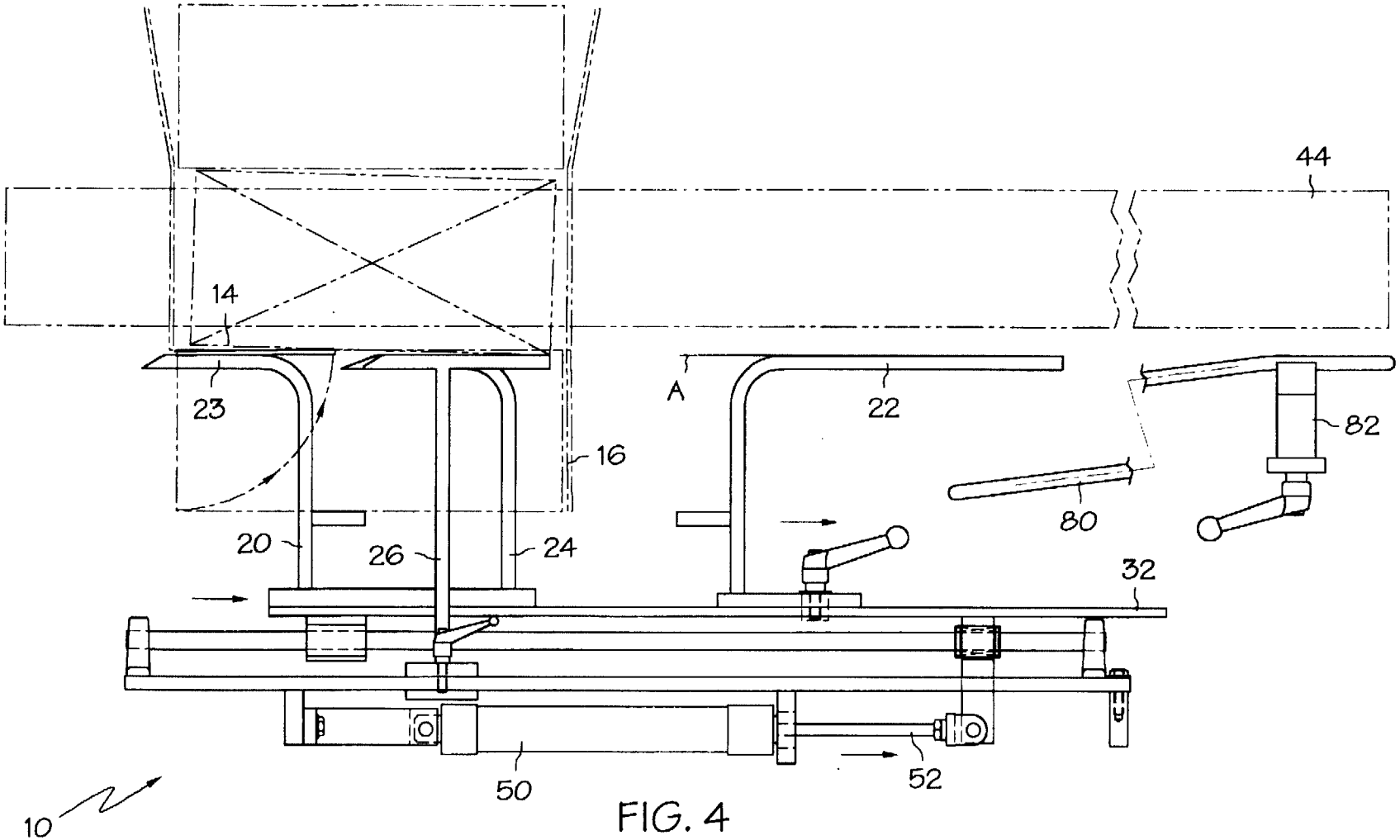

The folding operation is as follows. The item to be packaged 46 is moved into position on top of the "L" support bar 24 and the "T" support bar 26 by a pair of dogs (not shown). The "L" support bar 24 and "T" support bar 26 thereby serve to retain the item 46 so that its bottom is located at an elevation substantially at plane A. Once in the proper position, an operator places the sleeve 12 over the item 46. Once the sleeve 12 is placed over the item 46, the lower perimeter 47 of the sleeve 12 is located generally at the elevation of plane A, and the flaps 14, 16, 18 extend downwardly below plane A. This position of the apparatus 10, sleeve 12 and item 46 is illustrated in FIG. 1. Once the sleeve 12 is located in the appropriate position, piston 50, as triggered by an operator, extends piston arm 52 outwardly. This causes the extension arm 56 and the shuttle 32 to also reciprocate to the right. First folding bar 20, "L" support bar 24, and second fold bar 22 also shift to the right. As first fold bar 20 contacts the trailing minor flap 14, the first folding portion 36 causes the trailing minor flap 14 to rotate upwards and in the downstream direction, as shown in FIG. 3. As shuttle 32 continues to reciprocate to the right, trailing minor flap 14 is moved into a generally horizontal position, generally perpendicular to the panels 51, 53, 55, 57 and flush with plane A. As the flap 14 is rotated upwards, it may contact the "L" support bar 24, as shown in FIG. 3. However, as the shuttle 32 continues to reciprocate to the right, the "L" support bar 24 will eventually move out of contact with trailing minor flap 14. This allows the trailing minor flap 14 to be moved into its final horizontal position as shown in FIG. 4.

Figure 5:
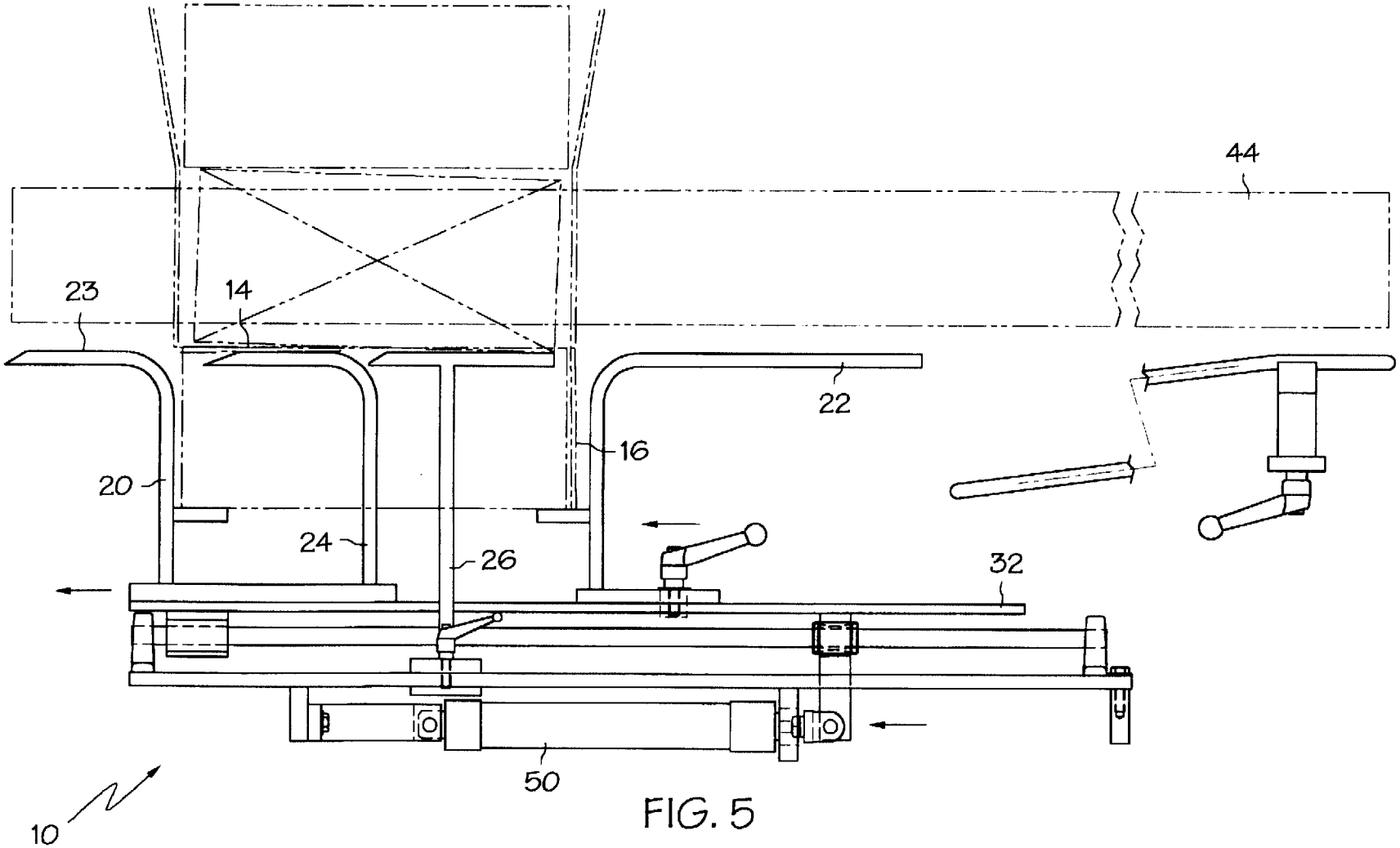

Once the trailing minor flap 14 is moved into position, piston 50 retracts piston arm 52, causing shuttle 32 to reciprocate to the left and return to its original starting position. As the shuttle 32 reciprocates to the left, the trailing minor flap 14 passes over generally horizontal portion 23 of first fold bar 22 and the top of the "L" support bar. The position of the various components when the shuttle 32 has returned to its original starting position is illustrated in FIG. 5. Once the shuttle 32 is in its original starting position as shown in FIG. 5, the side belts 44 are activated to move the sleeve 12 in the downstream direction. As the sleeve 12 moves downstream, the trailing minor flap 14 passes over the top of the "T" bar 26. As the sleeve 12 continues to travel downstream, leading minor flap 16 contacts second fold bar 22. Second folding portion 38 thereby urges the leading minor flap 16 to rotate in the upstream direction and to the left, as shown in FIG. 6. As the sleeve continues to travel downstream, the leading minor flap 16 is folded into a substantially horizontal position flush with plane A. The final position of the leading minor flap 16 is shown in FIG. 7.

Once both minor flaps 14, 16 are folded flush with plane A and thereby around the item 46, the sleeve 12 travels downstream and leading minor flap 16 and trailing minor flap 14 pass over generally horizontal portion 27 of second fold bar 22. In a preferred embodiment, the sleeve 12 then travels downstream for continued folding of the remaining unfolded flaps by angled fold bars 80. Angled fold bars 80 are shaped and positioned so as to fold the major flaps 18 flush with plane A as the box 12 is passed downstream.

Preferably, one angled fold bar 80 is located on either side of the path of the box 12. Angled fold bars 80 are adjustably secured to supporting beam 82, and arranged such that the fold bars 80 form an angle with respect to a horizontal plane and with respect to a vertical plane. The fold bars 80 angle in towards each other, thereby converging on the path of the box 12, and also slope upwards with respect to the downstream direction. Thus, as the box passes downstream, each major flap 18 contacts an angled bar 80. Because the fold bars 80 angle upwards and inwardly with respect to the downstream direction, the major flaps 18 are urged upwards and inwardly as the box travels downstream. Thus, the angled fold bars 80 urge the major flaps 18 into a substantially horizontal position (not shown) flush with plane A.

Once all of the panels are folded, the carton may be moved to the next processing station, such as a taping or sealing station. The folded box is then removed from the apparatus 10, and the apparatus 10 is then ready to receive another item 46 and a sleeve 12 to begin the folding process again.

The present invention is illustrated as showing the first fold bar 20 moving into contact with the unfolded sleeve 12, and the sleeve 12 then moving into contact with the second fold bar 22. However, it is within the scope of the present invention to provide an apparatus and method wherein the sleeve 12 is alternately moved into contact with the first fold bar 20 or, further alternately, the second fold bar 22 is moved into contact with th e sleeve 12. Various combinations and methods of causing the fold bars 20, 22 to contact with the sleeve 12 may be utilized without departing from the scope of the present invention.

The apparatus of the present invention is adapted to accommodate sleeves of varying dimensions. Tabs 34, 35 are movable along their respective fold bars 20, 22 to accommodate sleeves of varying heights. The second fold bar 22 is movable in the upstream or downstream direction by loosening and retightening of the locking handle 42. In this manner, the apparatus may be adapted to accommodate sleeves of varying lengths. Finally, the side belts 44 and angled fold bars 80 are movable to change the distance between them to accommodate sleeves of varying depths. All adjustments are easily accomplished as no tools are required, and a worker may thereby adjust the apparatus on-site. Furthermore, when it is desired to adjust the machine to accommodate a sleeve of a different size, a new sleeve of the desired size may be used to guide the adjustments. Once the sleeve 12 is placed over the item 46, the side belts 44, fold bar 22, and tabs 34, 35 may be adjusted by moving them until they fit tight against the sleeve.

The apparatus of the present invention is further adapted to accommodate single, tandem or quad packs. For example, two items stacked side-by-side, to form a tandem pack, or four items stacked side-by-side to form a quad pack may be accommodated by the apparatus of the present invention. The side belts 44 may be adjusted to account for the varying sizes of the packs.

As shown in FIG. 2, in a preferred embodiment of the invention, two first folding bars 20, two "L" support bars 24, two "T" support bars 26, and two second folding bars 22 are utilized. However, it is to be appreciated that the number of these elements may be varied without departing from the scope of the invention.

While the forms of apparatus herein described constitute a preferred embodiment of the invention, it is to be understood that the present invention is not limited to these precise forms and that changes may be made therein without departing from the scope of the invention.

What is claimed is:

1. An apparatus for folding a box around an item to thereby package the item in the box, said box being formed from an unfolded sleeve having a front panel, a back panel and two side panels, each of said panels having a lower edge defining a lower perimeter, said sleeve further having a trailing unfolded bottom flap and a leading unfolded bottom flap extending downwardly from said front and back panels, the apparatus comprising:

a support for the item to be packaged, a path defined by said apparatus along which said item is moved as it is packaged in said box, a first fold bar located upstream of said support in line with said path, said first fold bar having a first folding portion at substantially the same height as said support and being movable in a downstream direction along said path to contact said unfolded sleeve and fold said trailing bottom flap into the plane of said perimeter to form a partially folded sleeve;

a conveyor for moving said sleeve in a downstream direction along said path; and a second fold bar located downstream of said support, said second fold bar having a second folding portion at substantially the same height as said support such that said second folding portion contacts said partially folded sleeve and folds said leading bottom flap into the plane of said perimeter as said sleeve containing said item is conveyed downstream along said path.

2. The apparatus of claim 1 wherein said support includes a first pair of bars having a generally T-shape, said bars being arranged such that their top sections extend horizontally along said path.

3. The apparatus of claim 2 wherein said support further includes a second pair of bars having an inverted L-shape, said bars being movable in said downstream direction and being arranged such that their top sections extend generally horizontally along said path and are coplanar.

4. The apparatus of claim 3 wherein said first and second folding means and said pair of L-support bars are mounted on a shuttle which reciprocates along said path.

5. The apparatus of claim 4 wherein said first folding means and said second folding means further include adjustable tabs, said tabs acting as a stop for said leading and trailing panels to contact and being adjustable so that said perimeter is located at a predetermined height.

6. The apparatus of claim 5 wherein said second folding means is adjustable in the upstream and downstream directions on said shuttle to accommodate sleeves of varying lengths.

7. The apparatus of claim 6 wherein said conveyor includes a pair of generally vertical conveyor belts positioned to contact said side panels of said sleeve and thereby move said sleeve downstream along said path.

8. The apparatus of claim 7 wherein said pair of conveyor belts contact said walls and thereby support said sleeve at a predetermined height.

9. The apparatus of claim 8 wherein said pair of conveyor belts are adjustable to vary the distance between said belts to thereby accommodate sleeves of varying widths.

10. The apparatus of claim 9 wherein said sleeve further includes a pair of bottom side flaps extending from said side panels and said apparatus further includes a pair of side flap folding bars, one of said bars being located on each side of said path, said side flap folding bars converging on said path to thereby inwardly fold said pair of bottom side flaps.

11. The apparatus of claim 1 wherein said support further includes an intermediate support and a downstream support, said intermediate support being moveable in the downstream direction.

12. A method for folding a box around an item to be packaged, the box being formed from a sleeve having a front panel, a back panel and two side panels, each of said panels having a lower edge defining a lower perimeter, said sleeve further having a leading unfolded bottom flap and a trailing unfolded bottom flap extending downwardly from said front and back panels, the method comprising the steps of:

placing said item to be packaged on a support bar;

placing said sleeve around said item to be packaged such that the base of said item is at an elevation substantially equal to said perimeter;

causing a first fold bar having a first folding portion located at substantially the same height as said perimeter to contact and thereby fold said trailing flap into the plane of said perimeter; and causing a second folding bar having a second folding portion located at substantially the same height as said perimeter to contact said leading flap such that said second folding bar contacts and thereby folds said leading flap into the plane of said perimeter.

13. The method of claim 12 wherein said step of causing said first fold bar to contact said trailing bottom unfolded panel comprises moving said first fold bar into contact with said trailing bottom unfolded panel.

14. The method of claim 13 wherein said step of causing said second fold bar to contact said leading bottom unfolded panel comprises the step of moving said sleeve along a path such that said unfolded panel contacts said second fold bar.

15. The method of claim 14 wherein said step of placing said item on a support bar comprises placing said item to be packaged on a pair of T-shaped support bars located so as to support the base of said item to be packaged at substantially the same elevation as said perimeter.

16. The method of claim 15 wherein said step of placing said item on a support bar further comprises the step of placing said item on a pair of L-shaped support bars located so as to support said item to be packaged at substantially the same elevation as said perimeter.

17. The method of claim 16 wherein said first fold bar and said second fold bar further include adjustable tabs, said tabs acting as a stop for said leading and trailing flaps to contact and being adjustable so that said perimeter can be located at a predetermined height, said method further comprises the step of adjusting said tabs such that said perimeter is located at said predetermined height.

18. The method of claim 17 wherein said second folding means is lockingly adjustable, said method further comprising the step of adjusting said second folding means in the upstream or downstream direction to account for sleeves of varying lengths.

19. The method of claim 18 wherein said sleeve further includes a pair of bottom side panels and said method further includes the step of conveying said box along a pair of side flap folding bars, one such bar being located on each side of said path and converging on said path to thereby inwardly fold a pair of bottom side flaps.

* * * * *